US005634369A

United States Patent [19]

Anthony et al.

[11] Patent Number: 5,634,369

[45] Date of Patent: Jun. 3, 1997

[54] COMPOSITE DIAMOND WIRE DIE

[75] Inventors: Thomas R. Anthony, Schenectady, N.Y.; Bradley E. Williams, Worthington, Ohio

[73] Assignee: General Electric Company, Schenectady, N.Y.

[21] Appl. No.: 499,238

[22] Filed: Jul. 7, 1995

[51] Int. Cl.[6] ..... B21C 3/00

[52] U.S. Cl. ..... 72/467

[58] Field of Search ..... 72/467; 423/446

[56] References Cited

U.S. PATENT DOCUMENTS

| | | | |
|---|---|---|---|
| 3,433,049 | 3/1969 | Neaser et al. | 72/467 |
| 3,831,428 | 8/1974 | Wentorf, Jr. et al. | 72/467 |
| 4,016,736 | 4/1977 | Carrison et al. | 72/41 |
| 4,303,442 | 12/1981 | Hara et al. | 72/467 |
| 4,392,397 | 7/1983 | Engelfriet et al. | 72/467 |
| 4,462,242 | 7/1984 | Morgenthaler | 72/467 |
| 4,872,333 | 10/1989 | Burnand | 72/467 |
| 5,110,579 | 5/1992 | Anthony et al. | 423/446 |
| 5,273,731 | 12/1993 | Anthony et al. | 423/446 |
| 5,310,447 | 5/1994 | Anthony et al. | 423/446 |
| 5,360,479 | 11/1994 | Banholzer et al. | 117/84 |
| 5,361,621 | 11/1994 | Anthony et al. | 72/467 |
| 5,363,687 | 11/1994 | Anthony et al. | 72/467 |
| 5,377,522 | 1/1995 | Anthony et al. | 72/467 |
| 5,387,447 | 2/1995 | Slutz et al. | 428/34.1 |
| 5,511,450 | 4/1996 | Nagao | 72/467 |

FOREIGN PATENT DOCUMENTS

494799A1 1/1992 European Pat. Off. .

OTHER PUBLICATIONS

Wilks, John and Eileen Wilks. "Properties and Applications of Diamond". Oxford, U.K. 1991. Chapter 17, Miscellaneous applications. pp. 504–507.

Wilks, John and Eileen Wilks. "Properties and Applications of Diamond". Oxford, U.K. 1991. Chapter 13, Wear and surface characteristics. pp. 337, 342, 343, and 377.

*Primary Examiner*—David Jones
*Assistant Examiner*—John Paradiso
*Attorney, Agent, or Firm*—William H. Pittman

[57] ABSTRACT

A composite diamond wire die for drawing wire has a single crystal or HTHP diamond substrate and a CVD layer or layers deposited thereon. The wire die bore extends through both the substrate and the CVD layers, with the wire bearing surface being located within the substrate.

26 Claims, 1 Drawing Sheet

COMPOSITE DIAMOND WIRE DIE

FIELD OF THE INVENTION

This invention is related generally to diamond dies for wire drawing. More particularly, it is related to a composite diamond die comprising portions made from both CVD and natural or HPHT diamond.

BACKGROUND OF THE INVENTION

Wires of metals such as tungsten, copper, iron, molybdenum, and stainless steel are produced by drawing the metals through diamond wire dies. Diamond wire dies have been fabricated using single crystal diamonds, however, such dies are difficult to fabricate, tend to chip easily, easily cleave, and often fail catastrophically in use because of the extreme pressures involved during wire drawing.

With reference to single crystal diamond wire dies, it is reported in Properties and Applications of Diamond, Wilks et al, Butterworth-Heinemann Ltd 1991, pages 505–507: "The best choice of [crystallographic] direction is not too obvious because as the wire passes through the die its circumference is abrading the diamond on a whole 360° range of planes, and the rates of wear on these planes will be somewhat different. Hence, the originally circular hole will not only grow larger but will loose its shape. However, <110> directions offer the advantage that the wire is abrading the sides of the hole with {001} and {011} crystallographic orientations in abrasion resistant directions."

Diamond dies which avoid some of the problems attendant with natural diamonds of poorer quality comprise microporous masses compacted from tiny crystals of natural or synthesized diamonds or from crystals of cubic boron nitride. The deficiencies of such polycrystalline hard masses, as indicated in U.S. Pat. No. 4,016,736 to Carrison et al., are due to the presence of micro-voids/pores and soft inclusions. These voids and inclusions can be more than 10 microns in diameter. The improvement of Carrison et al. incorporates an impregnated lubricant in the microporous wire die and a metal cemented carbide jacket to enclose the die.

European Patent Application 0 494 799 A1 describes a polycrystalline CVD diamond layer having a hole formed therethrough and mounted in a support. As set forth in column 2, lines 26–28, "The relatively random distribution of crystal orientations in the CVD diamond ensures more even wear during use of the insert." As set forth in column 3, lines 50–54, "The orientation of the diamond in the polycrystalline CVD diamond layer 10 may be such that most of the crystallites have a (111) crystallographic axis in the plane, i.e. parallel to the surfaces 14, 16, of the layer 10."

Other crystal orientations for CVD films are known. U.S. Pat. No. 5,110,579 to Anthony et al describes a polycrystalline diamond film comprising substantially transparent columns of diamond crystals having a <110> direction perpendicular to the base, as illustrated in FIG. 3 of this patent.

As discussed in, for example, U.S. Pat. Nos. 5,361,621, 5,363,687 and 5,377,522, CVD diamond has been preferred for wire die applications because of its high purity and uniform consistency. Natural diamonds typically are less pure compositionally, and have less morphological consistency. Also, because CVD diamond can be usually produced without attendant voids, it is often more desirable than polycrystalline or single crystal diamond produced by high temperature and high pressure (HPHT) processes. However, the surfaces of CVD diamonds used for wire dies have been observed in some instances to contain to pits or voids after the polishing operations used to form the surfaces of the die, or after wire drawing. These pits or pores may result from the CVD deposition process or from pull-out of fine grains during these operations. Pull-out may result from relatively low grain boundary strength, which may in turn be related to the CVD deposition process. CVD deposited carbon films are known to contain hydrogen that is bonded to the carbon, particularly in the grain boundaries, which in turn results in a reduction in the number of carbon-carbon bonds across the grain boundaries, and hence, a reduction in the grain boundary strength. The degree of pitting observed is greater than that which occurs when natural diamonds that are subject to the same die forming operations.

Pits or pores are of concern, because they are expected to limit the maximum strength of wire dies in which they occur and, therefore, the types of wire that may be formed in them (e.g. relatively ductile alloys such as many copper alloys versus less ductile alloys, such as most tungsten alloys. Pits or voids may also cause defects in the drawn wire, particularly if they occur in the bearing surface of the die, where most of the wire deformation occurs.

Therefore, it is desirable to combine single crystal and CVD diamond to make composite diamond wire dies that take advantage of the properties and characteristics of both.

SUMMARY OF THE INVENTION

A composite diamond wire die combines the advantages of natural and HPHT diamond with the advantages of CVD diamond. A relatively small piece of natural or HPHT diamond is used as a substrate for a layer or layers of CVD diamond. The CVD diamond is used to add sufficient material to the substrate to permit the fabrication of a diamond wire die.

The present invention may be briefly described as a composite diamond wire die for drawing wire of a predetermined diameter, comprising: a substrate comprising natural or HPHT diamond and having a first surface and an opposing second surface; a layer of CVD diamond deposited on the first surface of said substrate (first layer); and at least one wire die bore comprising a wire bearing portion of substantially circular cross-section and a bore axis, said wire die bore extending through both the substrate and the CVD diamond layer, said wire bearing portion located at least partially within the substrate, wherein the circular cross-section of the wire bearing portion is determinative of the diameter of a wire drawn through said wire die bore.

In a preferred embodiment, a wire die of the present invention has a wire die bore extending entirely through the die along a bore axis where the substrate has a <110> direction extending substantially parallel to the bore axis.

One object of the present invention is to produce a diamond wire die that is less susceptible to voids or pullout within the wire die bore. Another object of the present invention is to provide a diamond wire die that can draw wire with higher yield strengths than may be drawn with CVD diamond wire dies. A further object is to provide a diamond wire die that is constructed from less costly materials than dies made entirely from single-crystal natural or synthetic single-crystal HPHT diamonds.

DETAILED DESCRIPTION OF THE INVENTION

Figure 1A:
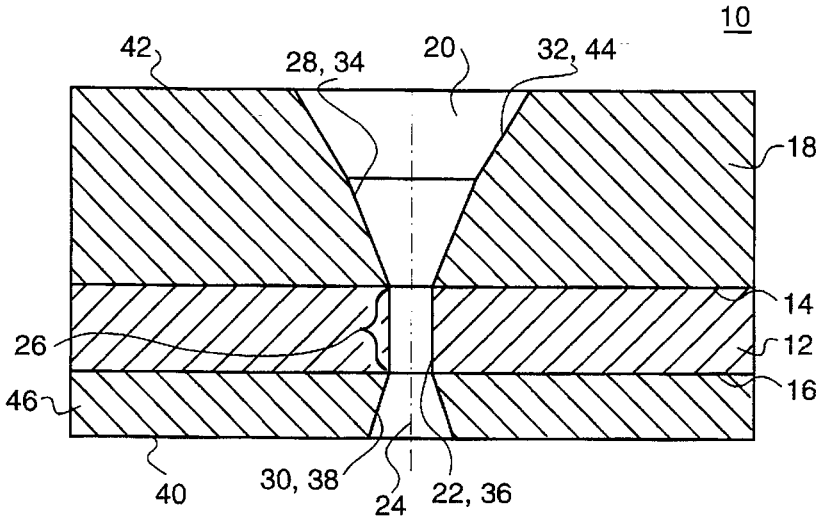
FIGS. 1A–C are cross-sectional illustrations of three embodiments of a composite diamond wire dies of the present invention.
Figure 1B:
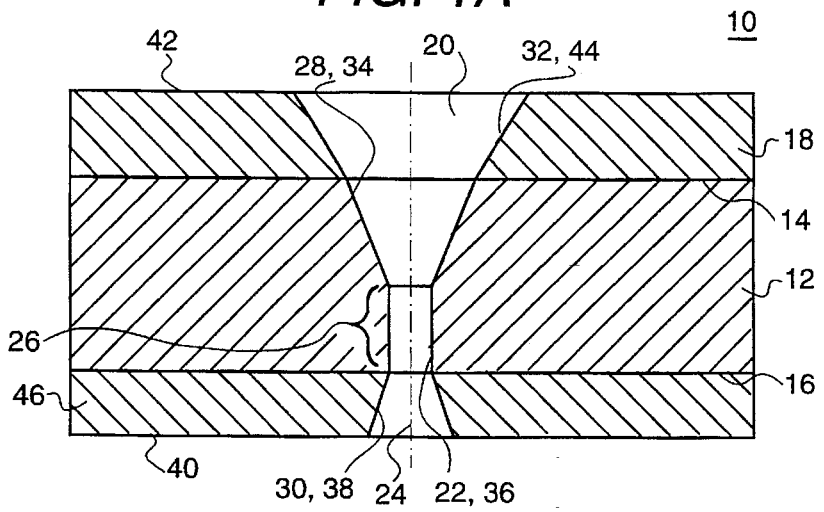
Figure 1C:
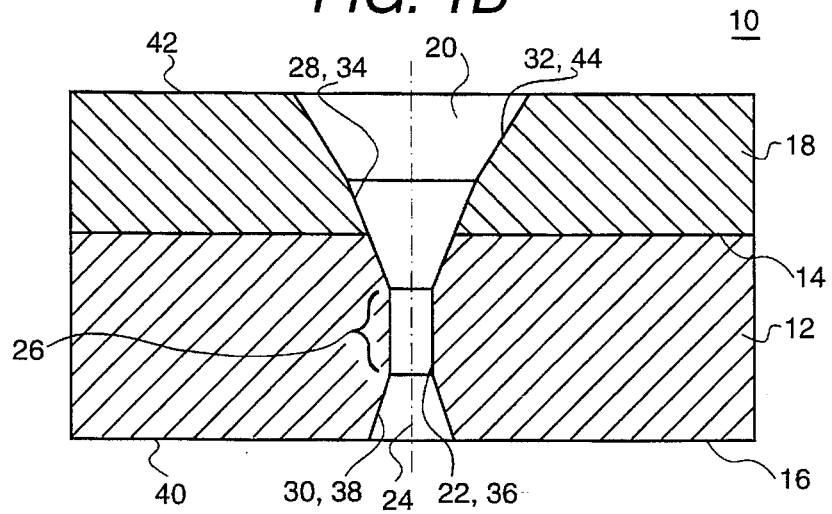

FIGS. 1A–C are cross-sectional illustrations of several embodiments of a composite diamond wire die 10 of the present invention. Wire die 10 is for drawing wire (not shown) of a predetermined diameter, and comprises: substrate 12 comprising natural or HPHT diamond and having first surface 14 and opposing second surface 16; a layer 18 of diamond deposited by chemical vapor deposition (CVD) onto first surface 14 of substrate 12 (first layer 18); and wire die bore 20 having wire bearing portion 22 of substantially circular cross-section and bore axis 24. Wire die bore 20 extends through both substrate 12 and first layer 18. Wire bearing portion 22 is located at least partially within substrate 12 (preferably completely within substrate 12), and the circular cross-section of wire bearing portion 12 is determinative of the diameter of a wire drawn through the wire die bore 20. In a preferred embodiment, wire bearing portion 22 comprises a straight bore section 26 having a circular cross-section. Wire die bore 20 typically also comprises first taper 28 opening outwardly in one direction from straight bore section 26 away from first surface 14 and second taper 30 opening outwardly in the opposite direction from straight bore section 26 away from the second surface 16. As illustrated in FIGS. 1A–C, first taper 28 and second taper 30 are also referred to herein as entrance taper 28 and exit taper 30, respectively. A wire to be drawn initially passes through entrance taper 28 where an initial size reduction occurs prior to passing through the straight bore section 26 and exit taper 30. Referring to diamond wire dies generally, there are four main internal surfaces, commonly identified as the entrance 32, approach 34, bearing 36 and exit 38 surfaces, as shown in FIG. 1A. In this description, approach 34, bearing 36 and exit 38 surfaces correspond to entrance taper 28, wire bearing portion 22 and exit taper 30, respectively. Entrance taper 28 typically extends for a greater distance along the direction of bore axis 24 than exit taper 30. Thus, straight bore section 26 is closer to bottom surface 40 of wire die 10 than to top surface 42. There is also a wide taper 44 opening onto top surface 42 that tapers to entrance taper 28. As shown in FIGS. 1A and 1B, wire die 10 may also comprise second layer 46 of diamond deposited by chemical vapor deposition (CVD) onto second surface 16 of substrate 12 (second layer 46).

Typical wire drawing dies have a disc-shape although square, hexagonal, octagonal, or other polygonal shapes may be used. Preferably, wire dies have a thickness of about 0.4–10 millimeters. The length measurement as in the case of a polygonal shape, or the diameter measurement as in the case of a rounded shape, is preferably about 1–20 millimeters. Preferred thicknesses are from 0.3–10 millimeters with preferred lengths being 1–5 millimeters. The wire bearing portion suitable for drawing wire is typically from 0.030 mm to 5.0 mm in diameter. Wire dies 10, as described herein, may be used to draw wire having desirable uniform properties. Wire die 10 may also contain a plurality of wire die bores 20, and these bores may have the same diameters or different diameters.

Composite diamond wire dies 10 are typically cut from a CVD coated substrate 12. Preferably, conductive CVD diamond layers can be cut by electro-discharge machining, while insulating films can be cut with a laser to form discs, squares, or other symmetrical shapes. Wire dies 10 may also be thinned to a preferred thickness, planarized or polished to a particular surface finish. These operations may be done by any suitable method, such as mechanical abrasion, laser polishing, ion thinning, or chemical methods. Prior to wire drawing, wire die 10 is mounted in a mechanical support (not shown) of a type well-known in the art in order to provide a means of holding wire die 10 during use and so as to resist axially aligned forces due to wire drawing.

Substrate 12 may be a natural diamond or a commercially available HPHT sintered diamond (e.g. Compax or Syndite available from GE Superabrasives or DeBeers, respectively). It is preferred that substrate 12 be free from voids and other defects that could result in pull-out in wire bearing portion 22 during wire-drawing. Also, in the case of substrates 12 formed from polycrystalline HPHT diamond, the grain boundary strength should be higher than the yield strength of the wire which is to be drawn. This is to avoid pull-out of grains or failure of the die during use. Preferably, substrate 12 comprises a single crystal of natural or HPHT diamond. It is also preferred that the <110> direction of the single crystal be oriented such that it is parallel to bore axis 24, because it is well-known that this direction offers the most desirable degree of resistance to wear and abrasion. In the case of HPHT diamond, it may be desirable to form substrate 12 from isotopically pure carbon (carbon consisting of a single isotope). Isotopically pure carbon is known to produce HPHT diamonds with enhanced thermal conductivity, on the order of 33 watts/$_{cm\text{-}K}$. Since the operating temperature of wire bearing portion 22 is one of the most significant determinants of the life of a wire die, the enhanced thermal conductivity of isotopically pure substrates should translate into longer die life than would otherwise be expected for wire dies of the present invention. Substrates 12 may also be formed from macles. Macles are naturally occuring thin plates of diamond with a (111) twin plane running parallel to and midway between the main opposing surfaces of the plate. They are found in abundance in alluvial deposits. Uncoated macles have been used in the past to make wire dies, but they have only been suitable previously for drawing extremely fine wires (e.g., 0.03–0.5 mm in diameter) of relatively ductile material, because of insufficient mechanical strength resulting from their thickness (e.g., 0.1–0.5 mm). Macles are believed to offer an advantage over single crystals for use as subsrate 12, because they have six <110> directions, rather than three as found in single crystals. Thus, wire bearing portion 22 formed from a macle would have six-fold rather than three-fold symmetry. Consequently, the wear of wire bearing portion 22 is expected to be more uniform, resulting in longer use of the die before repolishing of the bore. The thickness of substrates 12 of the present invention will range from about 0.1–2 mm. Therefore, the cost and of a single crystal or macle will be significantly reduced as compared to the cost of a diamond of sufficient quality and thickness necessary to form an entire wire die 10.

The combination of the thickness of first layer 18 and second layer 46 should be about 0.4–10 mm, a thickness sufficient to form the balance of the thickness of wire die 10. The distribution of thicknesses between first layer 18 and second layer 46 (if it is included) will be chosen to position substrate 12 such that wire bearing surface 22, entrance taper 28, or both, are positioned within substrate 12. A preferred technique for forming the first layer 18 and second layer 46 of CVD diamond is set forth in U.S. Pat. No. 5,110,579 to Anthony et al., which is herein incorporated by reference. According to the processes set forth in Anthony et al., diamond is deposited by CVD on a substrate, which in the case of the present invention is also diamond, by a filament process. According to this process, an appropriate gas mixture containing a carbonaceous gas, such as such methane as set forth in the example is passed over a heated filament in a sufficient quantity, at a sufficient temperature and for a sufficient length of time to create a diamond layer and build up the layer to a desired thickness. As also described in this patent, a preferred film comprises substantially transparent columns of diamond crystals having a <110> direction perpendicular to the plane of the substrate. Grain boundaries between adjacent diamond crystals having hydrogen atoms saturating dangling carbon bonds is preferred, wherein at least 50 percent of the carbon atoms are believed to be tetrahedral bonded based on Raman spectroscopy, infrared and X-ray analysis. It is also contemplated that H, F, Cl, O or other atoms may saturate the dangling carbon bonds.

The morphology of the CVD layers may also be varied using well known techniques, particularly by controlling the temperature of substrate 12 as the CVD layer is being deposited, as described for example in "Diamond Films 93", Proceedings of the 4th European Conference on Diamond, Diamond-like and Related Materials, Albufeira, Portugal, September 1993, Editors P. K. Bachmann, I. M. Golden, J. T. Glass and M. Kamo Elsevier Lausanne. Possible morphologies include: epitaxial or nearly epitaxial single crystal layers, layers comprising a plurality of large, columnar grains on the order of 50 microns or more, as well as layers that have a grain size that varies through the thickness of the layer, such as layers having a region of smaller grains near first surface 14 and a region of larger grains near the outer surface of wire die 10. To obtain larger grain sizes (e.g. 50 microns) or epitaxial layers, the temperature of substrate 12 during the deposition should be relatively hotter, on the order of 870°–1050° C., while smaller grain sizes (e.g. <25 microns) require temperatures on the order of 600°–850° C.

A preferred process for making the CVD layers is the filament process described herein. Additional preferred properties of these CVD diamond layers include a thermal conductivity greater than about 4 watts/cm-° K. The thermal conductivity of these CVD films may also be further enhanced by the use of isotopically pure carbonaceous gases for the CVD process, as described in U.S. Pat. No. 5,360,479 to Banholzer et al., which is herein incorporated by reference. The wear resistance and cracking resistance of wire dies 10 increases with increasing thermal conductivity. The CVD layer is preferably non-opaque or transparent or translucent and contains hydrogen and oxygen greater than about 1 part per million. The diamond film may contain impurities and intentional additives. Impurities may be in the form of catalyst materials, such as iron, nickel, or cobalt.

Diamond deposition on substrates made of Si, Ge, Nb, V, Ta, Mo, W, Ti, Zr or Hf results in CVD diamond layers that have fewer defects, such as cracks, than other substrates. By neutron activation analysis, it has been determined that small amounts of these substrate materials are incorporated into the CVD diamond films made on these substrates. Hence, it may be desirable to adapt the processes described herein to deposit layers that contain between 10 parts per billion and less than 10 parts per million of Si, Ge, Nb, V, Ta, Mo, W, Ti, Zr or Hf. Additionally, the CVD layers may contain more than one part per million of a halogen, i.e. fluorine, chlorine, bromine, or iodine. Additional additives may include N, B, 0, and P which may be present in the form of intentional additives. It is anticipated that CVD layers of the present invention may be made by other known CVD processes, such as microwave CVD processes.

It is also contemplated that CVD diamond layers having such preferred conductivity may be produced by other techniques such as microwave CVD and DC jet CVD. Intentional additives may include N, S, Ge, Al, and P, each at levels less than 100 ppm. It is contemplated that suitable films may be produced at greater levels. However, lower levels of impurities tend to increase toughness and wear resistance which are very desirable wire die properties. The most preferred films contain less than 5 parts per million and preferably less than 1 part per million impurities and intentional additives.

It is also well-known that CVD layers of the present invention may be deposited so as to contain intrinsic stresses, including intrinsic tensile stresses. For the method of deposition described herein, intrinsic tensile stresses are produced for substrate temperatures during deposition that are greater than about 740° C. The magnitude of these stresses is also known to increase with increasing temperature. Tensile stresses in the CVD layer or layers would be expected to place the substrate in compression which is known to be desirable for the purposes of decreasing the possibility of fracture within the wire die, particularly of wire bearing portion 22.

As shown in FIGS. 1A–C, at least a portion of wire bearing portion 22 is located within substrate 12 in order to obtain the enhanced wear resistance described herein, and it is preferred that the entire straight bore section 26 be located within substrate 12, in order to maximize the wear resistance of this section. Because entrance taper 28 is also deforming the wire, it may be desirable to select a substrate 12 with sufficient thickness such that all or part of entrance taper 28 is located within substrate 12, as illustrated in FIGS. 1B and 1C.

Wire die bore 20 may be formed by first piercing a pilot hole with a laser and then utilizing an ultrasonically vibrated pin in conjunction with a diamond grit slurry to abrade and form the bore by techniques known in the art.

The foregoing embodiments have been disclosed for the purpose of illustration of the present invention, and are not intended to be exhaustive of the potential variations thereof. Variations and modifications of the disclosed embodiments will be readily apparent those skilled in the art of diamond wire dies. All such variations and modifications are intended to be encompassed by the claims set forth hereinafter.

What is claimed is:

1. A composite diamond wire die for drawing wire of a predetermined diameter, comprising:

a substrate comprising a single crystal or a macle of natural of HPHT diamond and having a first surface and an opposing second surface;

a layer of CVD diamond containing intrinsic tensile stresses deposited on the first surface of said substrate (first layer); and a wire die bore comprising a wire bearing portion of substantially circular cross-section and a bore axis, said wire die bore extending through both the substrate and the CVD diamond layer and said axis intersecting said first and second surfaces, said wire bearing portion located at least partially within the substrate, whereby the circular cross-section of the wire bearing portion is determinative of the diameter of a wire drawn through said wire die bore.

2. The die of claim 1, wherein said substrate has a <110> direction aligned parallel to the bore axis.

3. The die of claim 2, wherein the thickness of said substrate is about 0.1–5 mm.

4. The die of claim 3, wherein the morphology of said first layer of CVD diamond comprises: 1) a region of smaller grains adjacent to said substrate and a region of larger grains adjacent to an outer surface of said first layer, 2) a plurality of large, columnar grains or 3) an epitaxial layer.

5. The die of claim 4, wherein said first layer has a <110> direction aligned parallel to the bore axis.

6. The die of claim 1, wherein said first layer comprises a plurality of large, columnar grains that are transparent, semi-transparent, translucent, or non-opaque.

7. The die of claim 1, wherein the bore axis is perpendicular to said substrate.

8. The die of claim 1, wherein said substrate and said first layer comprise a wire die having a thickness of about 0.3–10 millimeters.

9. The die of claim 1, wherein the wire bearing portion comprises a straight bore section having a circular cross-section.

10. The die of claim 8, wherein the wire die bore further comprises a first taper opening outwardly in one direction from the straight bore section away from the first surface and a second taper opening outwardly in the opposite direction from the straight bore section away from the second surface.

11. The die of claim 10, wherein the first taper is an entrance taper for the wire and the second taper is an exit taper.

12. The die of claim 11, wherein the entrance taper is located at least partially within said substrate.

13. The die of claim 11, wherein the entrance taper extends for a greater distance along the bore axis than the exit taper.

14. The die of claim 1, further comprising a second CVD diamond layer containing intrinsic tensile stresses deposited on the second surface of the substrate.

15. The die of claim 14, wherein said substrate, said first layer and said second layer have a thickness of about 0.3–10 millimeters.

16. The die of claim 1, wherein the wire die has outer surfaces that have been planarized or thinned by mechanical lapping, laser polishing, or ion finishing to produce a desired surface finish or thickness of the wire die.

17. The die of claim 1, wherein said first layer is deposited by a process comprising passing a carbonaceous gas over a heated filament at a rate and for a time sufficient build up the CVD layer to a desired thickness.

18. The die of claim 1, wherein said CVD diamond has a thermal conductivity greater than about 4 watts/cm-° K.

19. The die of claim 1, wherein said substrate, said first layer or both are formed from an isotopically pure carbonaceous material.

20. The die of claim 1, wherein said first layer is transparent, translucent or non-opaque and contains hydrogen and oxygen in a concentration greater than about 1 ppm.

21. The die of claim 1, wherein said first layer contains less than 1 ppm of impurities and intentional additives.

22. The die of claim 1, wherein the CVD layer contains more than 1 ppm of a halogen comprising fluorine, chlorine, bromine, or iodine.

23. The die of claim 1, further comprising a plurality of wire die bores each having a wire bearing portion of substantially circular cross-section and a bore axis, said wire die bore extending through both the substrate and the CVD diamond layer, said wire bearing portions located at least partially within the substrate, wherein the circular cross-section of the wire bearing portions is determinative of the diameter of a wire drawn through said wire die bores.

24. The die of claim 1, wherein the diamond wire die is mounted in or attached to a fixture which is suitable for the support of the die.

25. The die of claim 1, wherein the diamond has an electrical resistivity of less than 1000 ohm-centimeter at room temperature.

26. The die of claim 1, wherein said first layer comprises a microstructure having grain boundaries, the grain boundaries comprising hydrogen saturated dangling carbon bonds.

* * * * *